US005084803A

United States Patent [19]

Lan

[11] Patent Number: 5,084,803

[45] Date of Patent: Jan. 28, 1992

[54] STRUCTURE OF A TOY LAMP

[76] Inventor: Ching-Hwei Lan, No. 9, Alley 1, Lane 458, Yuang Ho Rd., Chung Ho City, Taiwan

[21] Appl. No.: 673,566

[22] Filed: Mar. 22, 1991

[51] Int. Cl.[5] ..... F21V 21/30

[52] U.S. Cl. ..... 362/35; 362/275; 362/806; 362/286; 446/242; 446/485

[58] Field of Search ..... 362/35, 806, 809, 361, 362/271, 272, 269, 275; 446/242, 241, 243, 244, 485, 408, 227

[56] References Cited

U.S. PATENT DOCUMENTS 2,218,013 10/1940 Tice et al. ..... 362/35
4,353,110 10/1982 Ellis ..... 362/35
4,858,079 8/1989 Ohashi ..... 362/35

FOREIGN PATENT DOCUMENTS 556379 7/1932 Fed. Rep. of Germany ..... 362/35

*Primary Examiner*—James C. Yeung
*Attorney, Agent, or Firm*—Browdy and Neimark

[57] ABSTRACT

A toy lamp comprises a transparent housing cover, a casing containing revolution driving assemblies, a revolving frame to drive a revolving ball into crosswise revolution, a revolving frame crosswise driving assembly, a revolving ball having a plurality of translucent openings from which differently colored light beams are transmitted, a revolving ball lengthwise driving assembly, a power supply unit for a light bulb inside of the revolving ball and a casing base with shockproof function. The revolving ball inside the housing could revolve in both crosswise and lengthwise directions slowly upon supply of electricity and out of a plurality of translucent openings of its ball wall transmit an interlaced moving of the light beams in different colors. It could be used as light source in a paper fancy lantern or utilized alone in alternative.

1 Claim, 3 Drawing Sheets

STRUCTURE OF A TOY LAMP

FIELD OF THE INVENTION

This invention relates to structure of a toy lamp, and particularly to one with a revolving ball which transmits interlaced moving of differently colored light beams from translucent openings in the ball wall as it revolves in both a horizontal and vertical plane when in operation. The lamp can be used as light source in a paper fancy or be utilized alone if preferred to increase festival atmosphere.

BACKGROUND OF THE INVENTION

Paper fancy lanterns are very popular among children for festival celebration and some of which still employ the old-fashioned candle light. It is known that children can be burnt if the lantern catches fire. Another improved kind of lantern utilizes battery electricity and a small light bulb to give it brightness. Though absolutely safe, this fixed-styled light source provides little amusement. It is often seen that children are soon tired of playing with it and have no more interest left.

OBJECTS OF THE INVENTION

A major objective of this invention is to provide a kind of toy lamp which not only could be used as light source in a paper fancy lantern with safety but also emits an interlaced moving of differently colored light beams to promote its playfulness. A further objective is realized as the lamp is not limited to use with a paper fancy lantern but can be used alone in the indoor, outdoor, automobile or any other desired place.

SUMMARY OF THE INVENTION

Structure of a toy lamp comprises a transparent housing cover, a casing including revolution driving assemblies, a revolving frame to bring a revolving ball into revolution in a horizontal plane, a revolving frame horizontal driving assembly, a revolving ball from which differently colored light beams are transmitted, a revolving ball vertical driving assembly, a power supply unit providing the revolving ball with electricity and a casing base. As the revolving ball is driven to revolve in both a horizontal and vertical plane upon electricity supply, differently colored light beams will be transmitted from a plurality of translucent openings in the ball wall in interlaced moving state. It could be used as light source in a paper fancy lantern or can be utilized alone for increasing festival air.

SPECIFIC DESCRIPTION

Figure 1:
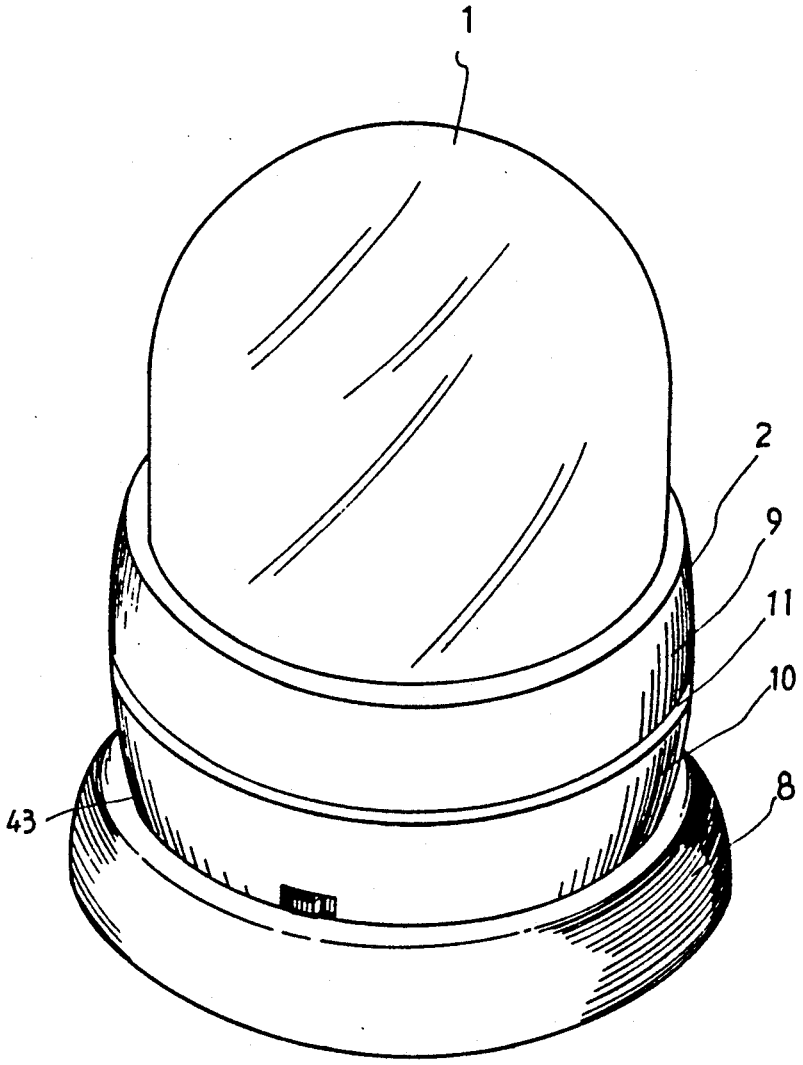
FIG. 1 is an appearance perspective of a preferred embodiment of this invention.
Figure 2:
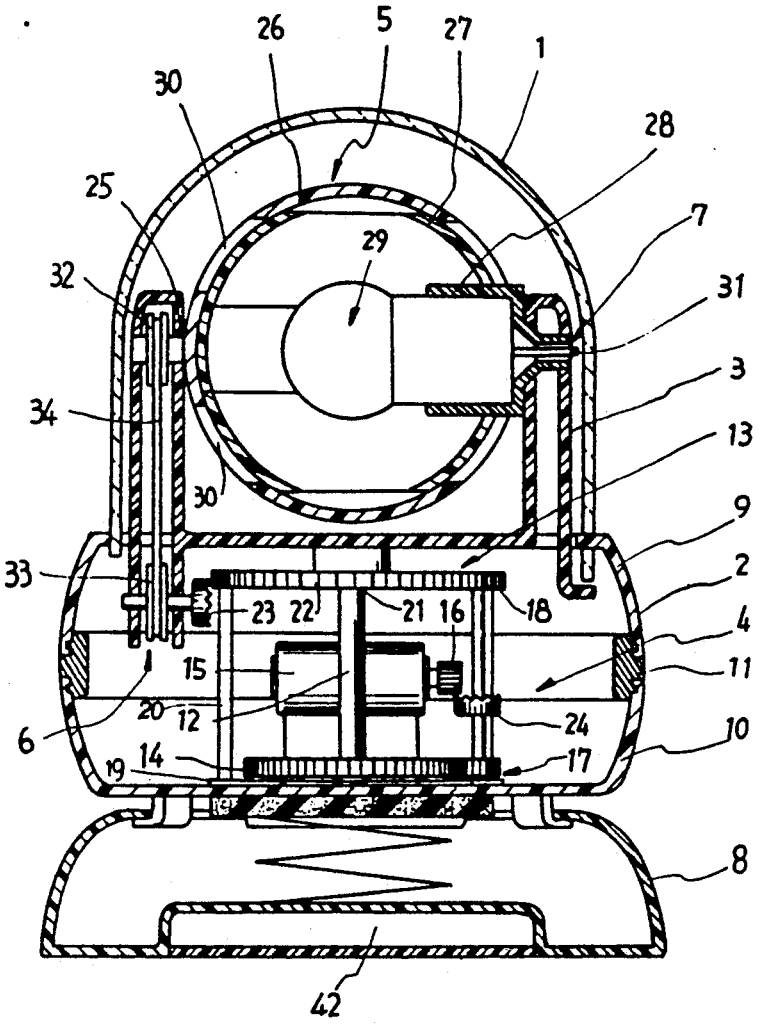
FIG. 2 is a sectional view taken along the A——A line in FIG. 1.

Referring to FIGS. 1, 2, this invention comprises housing cover 1, casing 2, revolving frame 3, revolving frame horizontal driving assembly 4, revolving ball 5, revolving ball vertical driving assembly 6, power supply unit 7 and casing base 8. Wherein, housing cover 1 is made of transparent material, arcuate in shape, and has an engaging lug around periphery of its lower open end for engagement with the upper open end of casing 2. Revolving frame 3 and revolving ball 5 are enclosed in housing cover 1. Casing 2, connected beneath housing cover 1, is drumlike as a whole and made up with upper casing 9 and lower casing 10 connected by means of joint loop 11. The lower end of casing 2 is engaged with casing base 8, and revolution driving assemblies 4, 6 as well as partial power supply unit 7 are enclosed in casing 2.

As FIG. 2 shows, revolving frame 3 has a generally Ushaped upper part for connection with revolving ball 5 and a lower part where a revolution shaft 12 is provided in the center to which the shaft hole of center of gear support 13 is pivotedly connected. Around the lower end, or upper end, of revolution shaft 12 is connected a following gear 14 horizontally of revolving frame driving assembly 4 in order to bring revolving frame 3 into horizontal revolution. Revolving horizontal frame driving assembly 4 comprises gear support 13, motor 15, main gear 16, slowing down gears set 17 which mesh with following gear 14. Wherein, gear support 13 consists of at least two plates 18, 19 fixed in parallel by connecting strut 20 and cross installed in casing 2 wherein the shaft hole 21 of center of gear support 13 is pivotedly connected with revolution shaft 12 of revolving frame 3. Around the periphery of the upper plate 18 of gear support 13, there is provided an integral outer gear 22 for driving a crown gear 23 of vertical revolving ball driving assembly 6 in engagement with crown gear 23. Between plates 18, 19 is positioned motor 15 having a main gear 16 connected to its output shaft which engages and turns a crown gear 24 which in turn drives slowing down gears set 17. Gears 17 drives following gear 14 which carriers and turns revolution shaft 12 and thereby revolving frame 3 into a slow horizontal revolution when in operation.

As FIG. 2 shows, revolving ball 5 is connected pivotedly with the upper ends of revolving frame 3 by means of a symmetry of hollow shafts 25 thereof. Revolving ball 5 which comprises a ball casing 26 having translucent strips 27, a bulb seat 28 and a light bulb 29. Ball casing 26 is formed by engaging of two semicircular casings (not shown) made of opaque material each provided with a symmetric shaft 25 outside of the opposed center point. The remaining area of the ball casing is arranged with a plurality of translucent openings 30 from which light beams are emitted through at least three differently colored translucent strips 27 used to cover the inner side of each of translucent opening 30. This results in emitting light beams with at least three different colors. Bulb seat 28 is connected in the interior to one of hollow shafts 25 of ball casing 26 which allows the extending out of conductable bar 31 thereof to connect with the electric brushes a power source for light bulb 29. Light bulb 29 is cross connected to bulb seat 28. The remaining shaft 25 of ball casing 26 is fixed to vertical revolving ball driving assembly 6. Assembly 6 consists of a upper pulley 32 to which shaft 25 is fixed, a lower pulley 33, a belt 34, a crown gear 23 and an outer gear 22. Wherein, upper pulley 32 is connected to the end of shaft 25 and belt 34 establishes connection with lower pulley 33 in the revolving frame lower area. Lower pulley 33 has a crown gear 23 connected to its axis which engages outer gear 22 of the periphery of upper plate 18. Therefore, as revolving frame 3 is driven into horizontal revolution by outer gear 22 and driving crown gear 23, lower pulley 33 will be driven and in turn bring upper pulley 32 as well as the connected revolving ball 5 to revolve in a vertical plane slowly. It is thus understood that revolving ball 5 can revolve in both a vertical and horizontal plane.

Figure 3:
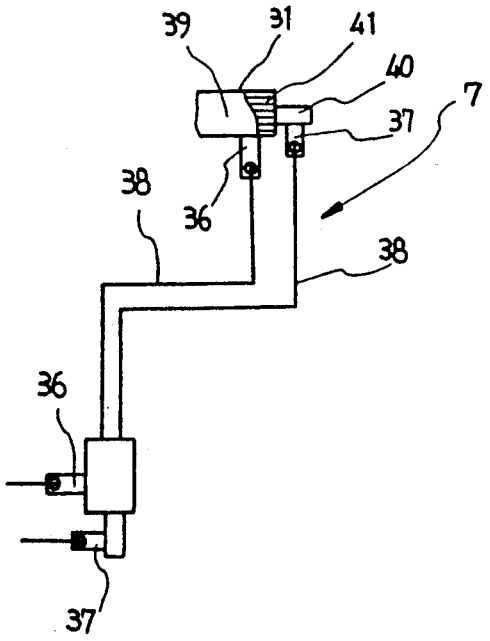
FIG. 3 shows the installing of power supply unit for revolving ball of this invention.

As FIG. 3 shows, power supply unit 7 for revolving ball 5 which consists of a conductible bar 31 of bulb seat 28, two pairs of electric brushes 36, 37 and a power lead 38. Wherein, conductible bar 31 extends out of center of the revolving ball shaft 25 and revolves along with the vertical revolution of revolving ball 5, and which is made of two co-centered conductible metals 39, 40 arranged with insulation 41 in between to facilitate keeping close contact with electric brushes 36 in revolution. Connected to the rear end of electric brushes 36, power lead 38 is fixed on revolving frame 3 and extends out of the center of revolution shaft 12 of revolving frame 3 to make connection with conductible bar 31 and the other pair of electric brushes 37. Power lead 38 could revolve along with revolving frame 3 thereby. Electric brushes 37 are connected with the power source to provide light bulb 29 with electricity.

As FIG. 2 shows, casing base 8 is the casing bottom seat. The inside of casing base 8 is arranged with shock-proof materials to withstand the outside force and prevent it from reaching to revolving ball 5. And battery seat 42 and power source receptacle (not shown) are provided too therein. It is, therefore, understood this invention could use the self-prepared battery electricity or the outside power source in alternative.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

I claim:

1. A toy lamp which comprises;

a transparent convex housing cover;

a casing having an open top;

said housing removably engaged in said open top of said casing;

a cup-shaped frame rotatably mounted on a vertical shaft on said casing;

an opaque ball having a plurality of slots covered by different colored transparent material;

said opaque ball having horizontal shafts rotatably mounted on said cup-shaped frame;

a first driving means connected to said vertical shaft for rotating said cup-shaped frame around an axis of said vertical shaft, a second driving means engaged to be driven by said first driving means for rotating one of said horizontal shafts of said opaque ball around an axis of said horizontal shafts;

an electric motor and power source in said casing engaged to drive said first driving means and said second driving means simultaneously;

a bulb seat and a light bulb mounted in an interior of said opaque ball and connected to an electric power source;

wherein, when said electric motor and said light bulb are operating said cup-shaped frame rotates in a horizontal plane and said opaque ball rotates in a vertical plane thereby dispersing colored light through said plurality of slots covered by said different colored transparent material in a plurality of directions.

* * * * *